US006988923B2

(12) United States Patent
Kobayashi et al.

(10) Patent No.: US 6,988,923 B2
(45) Date of Patent: Jan. 24, 2006

(54) METHOD FOR MANUFACTURING FLUORESCENT LAMP USING LEAD WIRE HOLDING BLOCK

(75) Inventors: Kazumasa Kobayashi, Oku-gun (JP); Kazuyoshi Sudou, Oku-gun (JP); Masahiro Takeuchi, Bizen (JP); Izumi Shoho, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 176 days.

(21) Appl. No.: 10/377,970

(22) Filed: Feb. 28, 2003

(65) Prior Publication Data

US 2004/0171327 A1 Sep. 2, 2004

(51) Int. Cl.
*H01J 9/00* (2006.01)
*H01J 9/18* (2006.01)
*H01J 9/28* (2006.01)

(52) U.S. Cl. ..... 445/27; 445/67; 445/22

(58) Field of Classification Search ..... 445/11, 445/23, 26–29, 32, 33, 35, 42, 43; 220/2 RR, 220/2.2; 65/138, 140
See application file for complete search history.

(56) References Cited

U.S. PATENT DOCUMENTS

| | | | | | |
|---|---|---|---|---|---|
| 2,315,292 | A | * | 3/1943 | Richardson et al. | 65/140 |
| 3,316,049 | A | * | 4/1967 | Brown | 445/27 |
| 3,544,188 | A | * | 12/1970 | Mosby et al. | 445/27 |
| 4,334,725 | A | * | 6/1982 | Teshima et al. | 445/22 |
| 5,118,985 | A | * | 6/1992 | Patton et al. | 313/485 |

FOREIGN PATENT DOCUMENTS

| | | | |
|---|---|---|---|
| JP | 49-3564 | | 1/1974 |
| JP | A-49(1974)-3564 | * | 1/1974 |
| JP | 51-3628 | | 2/1976 |
| JP | 54-1111 | | 1/1979 |
| JP | 56-65435 | | 6/1981 |
| JP | 60-95829 | | 5/1985 |
| JP | 61-271788 | | 12/1986 |
| JP | 6-290735 | | 10/1994 |
| JP | 10-40813 | | 2/1998 |

* cited by examiner

*Primary Examiner*—Mariceli Santiago
*Assistant Examiner*—Elizabeth Rielley
(74) *Attorney, Agent, or Firm*—Hamre, Schumann, Mueller & Larson, P.C.

(57) ABSTRACT

A fluorescent lamp is manufactured according to the processes including: arranging a pair of lead wires between a holding block provided with two lead-wire grooves for grasping the pair of lead wires and an auxiliary holding block provided with grooves corresponding to the two-lead wire grooves in such a manner that both end portions of each of the pair of lead wires protrude out of the lead-wire grooves, whereby the pair of lead wires is supported to be sandwiched and to be fixed therebetween; attaching an electrode to tip ends of the protruding lead wires; inserting the lead wires that hold the electrode by grasping the same and protrude out of the holding block into an end portion of a glass tube; applying heat in the vicinity of the end portion of the glass tube so as to pinch-seal the lead wires; and detaching the holding block and the auxiliary holding block. Only the electrode is present between the lead wires, and therefore a simple, reliable and stable method for manufacturing a fluorescent lamp can be provided.

10 Claims, 3 Drawing Sheets

METHOD FOR MANUFACTURING FLUORESCENT LAMP USING LEAD WIRE HOLDING BLOCK

BACKGROUND OF THE INVENTION

1. Field of the Invention

The present invention relates to a method for manufacturing a fluorescent lamp. More specifically, the present invention relates to a method for manufacturing a fluorescent lamp in which a lead wire is not provided with a fixing bead (glass bead) and a method for manufacturing a fluorescent lamp by which a continuous process from the holding of a lead wire to the exhaustion of a glass tube can be conducted using a specific jig.

2. Related Background Art

Conventionally, as means for reducing a material cost and for making effective use of a luminescent length by omitting a stem for assembling an electrode, a method for manufacturing a stemless fluorescent lamp is known. For example, JP 6(1994)-290735 A describes a manufacturing method in which an electrode is attached to a pair of lead wires while the pair of lead wires is fixed with a glass bead, and the pair of lead wires is pinch-sealed to an end portion of a glass tube. Also, a method in which after a pair of thin electrode wires is fixed with a magnet and ends of the pair of electrode wires are fixed with a fixing bead, then one side of the pair of electrode wires is pinch-sealed to a discharge tube and processes such as exhaustion, filling and sealing-off are conducted using an end portion of a glass tube on the side that is not pinch-sealed is known as described in JP 54(1979)-1111 B.

In the above-described discharge lamps, the former one is manufactured as follows: firstly, the pair of lead wires is supported by certain means to be fixed with the glass bead, and then an electrode is attached thereto to form an assembled member. Next, each of the assembled member, an exhaust tube and the glass tube is grasped by their respective grasp means so as to conduct pinch-sealing of the lead wires to the glass tube. Next, the thus prepared glass tubes are collected, carried and transferred for an exhaustion step, and then are subjected to the exhaustion and the following processes to complete the discharge lamp. The latter discharge lamp is manufactured as follows: that is, the pair of long electrode wires is passed through fixing beads at a plurality of portions to form an assembled member, where the pair of long electrode wires is held by a member partially constituted with a magnet formed at one side surface. After this assembled member is supported by another means and is inserted in the narrow glass tube whose both ends are open, one side of the open ends is pinch-sealed. Next, the thus prepared glass tube is transferred to another step, where a process such as exhaustion is conducted using the other open end.

However, the above-described conventional methods for manufacturing a fluorescent lamp have the following problems: that is, as for the former method, since the step for fixing the lead wires with the glass bead is conducted prior to the attachment of the electrode to the lead wires, the pinch-sealing process of the glass tube requires separate grasp of the assembled member and the exhaust tube with respect to the lead wires. Therefore, there is considerable loss of man-hours and material, and the manufacturing process becomes complicated. In addition, the effective luminescent length becomes shortened by a rise in the electrode position due to the presence of the glass bead.

As for the latter method, the electrode member before the attachment of the fixing bead is held with the magnet formed partially and only at one side. Therefore, a holding power is weak, so that the electrode member might be detached before the insertion into the fixing bead, which would increase inefficiency of the process. Also, supporting means is required for pinch-sealing the assembled member of the electrode member to the glass tube, which would make the process complicated. Further, in order to conduct a process such as exhaustion using the open end of the glass tube on the side that is not pinch-sealed, an exhaust tube with a small diameter separately has to be connected, and therefore loss in material and inefficiency of the process would be generated.

SUMMARY OF THE INVENTION

Therefore, to cope with the above-described problems in the prior art, it is an object of the present invention to provide a simple, reliable and stable method for manufacturing a fluorescent lamp in which a bead is not present between lead wires.

To fulfill the above-stated object, the method for manufacturing a fluorescent lamp of the present invention includes the steps of: arranging a pair of lead wires between a holding block provided with two lead-wire grooves for grasping the pair of lead wires and an auxiliary holding block provided with grooves corresponding to the two-lead wire grooves in such a manner that both end portions of each of the pair of lead wires protrude out of the lead-wire grooves, whereby the pair of lead wires is supported to be sandwiched and to be fixed therebetween; attaching an electrode to tip ends of the protruding lead wires; inserting the lead wires that hold the electrode by grasping the same and protrude out of the holding block into an end portion of a glass tube; applying heat in the vicinity of the end portion of the glass tube so as to pinch-seal the lead wires; and detaching the holding block and the auxiliary holding block.

DETAILED DESCRIPTION OF THE INVENTION

According to a preferred embodiment of the present invention, while a pair of lead wires is fixed and held securely and firmly with a holding block and an auxiliary holding block without a presence of a glass bead or a fixing bead, a continuous and simple process can be carried out without loss and difficulty in the order of:

(1) to support an electrode by grasping it;

(2) to arrange an exhaust tube;

(3) to insert an assembled member including lead wires and the electrode and the exhaust tube into a glass tube;

(4) to pinch-seal; and (5) to exhaust.

Therefore, compared with the prior art, a considerable reduction in the number of man-hours, a reduction in the material cost and a stable quality and performance can be realized.

Preferably, at least one of the holding block and the auxiliary holding block is made of a magnetic substance. This is because the metal lead wires can be fixed provisionally, which can enhance the workability.

Preferably, the holding block further includes an exhaust-tube groove formed between the two lead-wire grooves for grasping an exhaust tube and the auxiliary holding block further includes a groove corresponding to the exhaust-tube groove.

Preferably, the lead-wire grooves and the exhaust-tube grooves are provided at opposed surfaces of the holding block and the auxiliary holding block. This configuration is convenient for fixing the lead wires and the exhaust tube.

Preferably, only the electrode is present between the lead wires of the finished fluorescent lamp.

Preferably, when arranging the pair of lead wires so that the both end portions of each of the pair of lead wires protrude out of the lead-wire grooves, the pair of lead wires is held to be substantially parallel with each other.

Preferably, after attaching the electrode to the tip ends of the protruding lead wires and before inserting the lead wires protruding from the holding block into the end portion of the glass tube, the exhaust tube is arranged so that both end portions of the exhaust tube protrude out of the exhaust-tube groove.

Preferably, when inserting the lead wires into the end portion of the glass tube, the exhaust tube also is inserted into the end portion of the glass tube.

Preferably, when pinch-sealing the lead wires by heat, the glass tube and the exhaust tube are integrated.

Preferably, after pinch-sealing the lead wires by heat and before detaching the holding block and the auxiliary holding block, gas filled in the glass tube is exhausted through the exhaust tube.

Preferably, after detaching the holding block and the auxiliary holding block, a tip end portion of the glass tube is sealed by heat and the exhaust tube is cut and removed.

Figure 3:
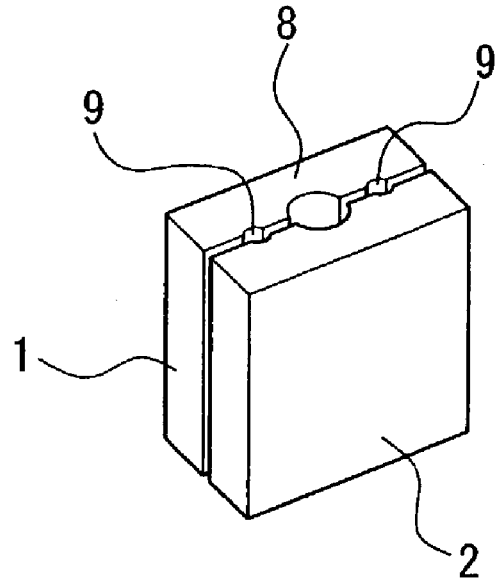
FIG. 3 is an external view in perspective of a cassette according to one embodiment of the present invention.

As described above, according to the method for manufacturing a fluorescent lamp of the present invention, a through process from the holding of lead wires to the exhaustion of the glass tube can be conducted continuously using one combination cassette. Therefore, practical improvements such as an improvement of the mass production capability, a reduction in the loss of material, stabilization of the quality and enhancement of the luminous flux can be realized. In addition, according to the method for manufacturing a fluorescent lamp of the present invention, the pinch-sealing can be conducted while the exhaust tube and the lead wires are held with a space among them maintained precisely. Therefore the electrode provided at the front ends of the lead wires can be arranged with stability in the glass tube, and a process of connecting the exhaust tube to the glass tube beforehand can be omitted. Note here that the term "cassette" used in this specification denotes a pair of blocks as shown in FIG. 3.

The following describes an embodiment of the present invention, with reference to the drawings.

FIGS. 1A to G illustrate a manufacturing process as one example of the method for manufacturing a fluorescent lamp of the present invention. FIG. 2 is an external view in perspective of a holding block of the present invention. FIG. 3 is an external view in perspective of a cassette of the present invention, which omits lead wires. Two lead wires 3 are sandwiched to be held between a holding block 1 made of a magnetic material, such as a magnet, and an auxiliary holding block 2 made of heat-resistant metal. The auxiliary holding member 2 may be made of a magnetic substance. The lead wires 3, for example, are lead wires for lamps with a diameter of 0.5 mm or more, including as at least a part of constituting materials an iron-nickel alloy or a Dumet wire in which an iron-nickel alloy is covered with copper. Reference numeral 4 denotes an electrode made of tungsten, 5 denotes a leg of the electrode 4, and 6 denotes an exhaust tube made of soda-lime glass or other types of glass, respectively. Preferably, the outer diameter of the exhaust tube is approximately in a range of 1.5 to 5.0 mm and the wall thickness of the same is approximately in a range of 0.2 to 0.8 mm. Reference numeral 7 denotes a glass tube for a fluorescent lamp made of soda-lime glass or other types of glass, 9 denotes a lead-wire groove to hold the lead wire 3, 8 denotes an exhaust-tube groove to hold the exhaust tube 6, 10 denotes a pinch-sealed portion of the glass tube 7, 11 denotes a tip-off portion of the exhaust tube 6, 12 denotes a cassette including the combination and integration of the pair of parallel lead wires 3 being held with the holding block 1 and being sandwiched between the holding block 1 and the auxiliary holding block 2, and 13 denotes a fluorescent lamp, respectively.

On an inner surface of the glass tube 7, a phosphor suitable for an intended use (not illustrated) is coated, and the fluorescent lamp 13 is filled with a predetermined amount of a filling substance made of at least one kind of material selected from a rare gas, mercury, various alloys of emitting mercury, amalgam, and a substance for forming amalgam, a gettering substance and the like.

The holding block 1 and the auxiliary holding block 2 may have the same shape, and each of the holding block 1 and the auxiliary holding block 2 is provided with the lead-wire grooves 9 and the exhaust-tube groove 8 to hold the pair of lead wires 3 and the exhaust tube 6, respectively. Although the shape of the grooves is not limited especially, the cross-section of the grooves preferably is a semicircle or a V shape that can fit with diameters of the lead wires and the exhaust tube, because these shapes facilitate the removal of the elements while exerting a strong holding power. The grooves are provided on at least one surface of each of the above-described holding members so as to extend like a straight line from an end of one side surface of the holding members to an end of the opposite side surface.

Either the whole or a portion of the holding block and the auxiliary holding block may be composed of a magnetic substance (magnet). With this configuration, the lead wires are grasped firmly, whereby a consistently stable assembly process beginning from the grasp of the lead wires and a manufacturing process of a fluorescent lamp can be conducted so as to realize advantages of the improvement of the mass production capability and the stabilization of the quality.

The following describes the manufacturing process of the present invention, with reference to FIGS. 1A to G.

Figures 1A, 1B, 1C, 1D, 1E, 1F, 1G:
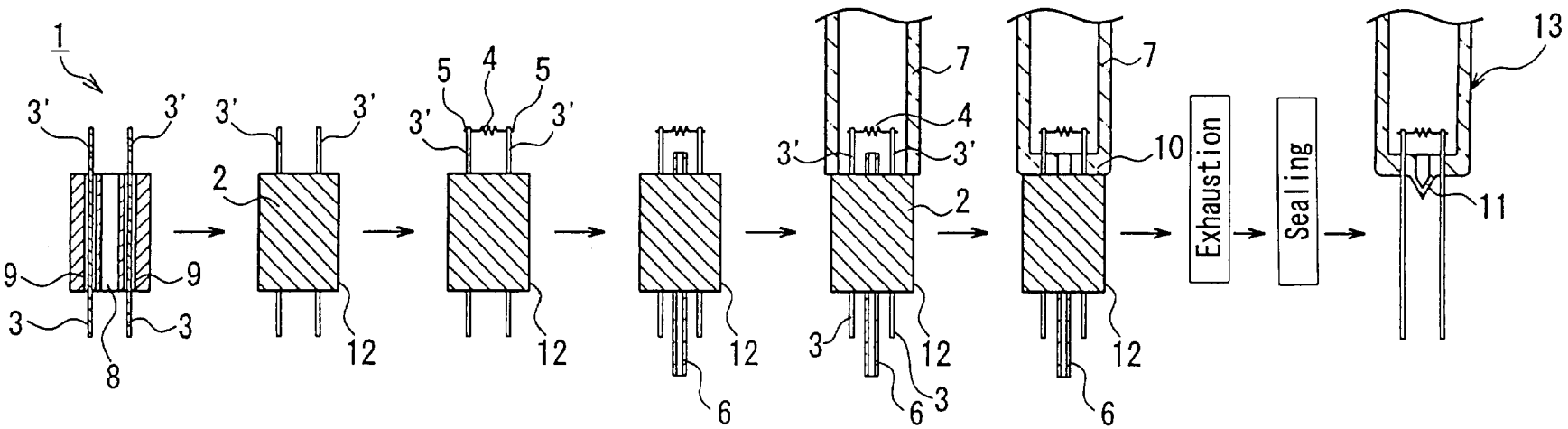
FIGS. 1A to G show a process of manufacturing a fluorescent lamp according to one embodiment of the present invention.
Figure 2:
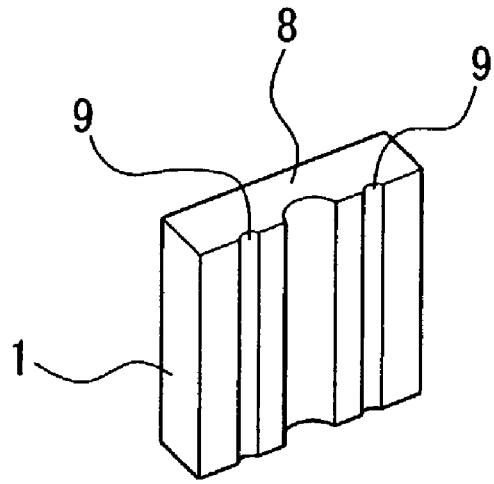
FIG. 2 is an external view in perspective of a holding block according to one embodiment of the present invention.

Firstly, the lead wires 3 are held by magnetic force in the parallel lead-wire grooves 9 of the holding block 1 so as to have protruding portions 3' (FIG. 1A). Next, the lead wires 3 are sandwiched with the auxiliary holding block 2, where the auxiliary holding block 2 is combined and integrated with the holding block 1 to form the cassette 12 (FIG. 1B). Next, the legs 5 of the electrode 4 are attached to the ends of the protruding portion 3' of the lead wires 3 to establish electrical connection (FIG. 1C). Next, the exhaust tube 6 is passed through the exhaust-tube groves 8 (between the lead wires 3) of the holding block 1 and the auxiliary holding block 2 to be held therein so as to have a protruding portion (FIG. 1D). The exhaust tube 6 may be grasped by another device to avoid being dropped.

Next, the lead wire protruding portions 3' and the protruding portion of the exhaust tube 6 on the side of the electrode 4 are inserted into the glass tube 7 from an end thereof (FIG. 1E), and the end of the glass tube 7 is melted by heat with a gas burner and the like so that the lead wire protruding portions 3 are pinch-sealed to form the pinch-sealed portion 10 (FIG. 1F). Here, the pinch-sealing is a process in which an end portion of the glass tube 7 is melted by heat with a gas burner and the like until the glass is softened to a fluid state, and then a pressure is applied from the side surface of the glass tube 7 to press the glass flat. Through this process, the end portion of the glass tube 7 is deformed toward the inside to be integrated with the exhaust tube 6 made of glass. When forming the pinch-sealed portion 10, a metal bar may be inserted into the exhaust tube 6 so as to avoid the blockage of the opening of the exhaust tube 6, and thereafter the metal bar is removed. Alternatively, another system may be adopted.

Next, the glass tube 7 is evacuated through the exhaust tube 6 and is filled with a suitable filling substance. Finally, the exhaust tube 6 is cut and removed (tip-off) to obtain the fluorescent lamp 13 (FIG. 1G).

As the filling substance, a substance that can be present in the glass tube 7 from the beginning, such as a gettering substance (e.g., titanium, an alloy of a titanium and aluminum), an alloy of emitting mercury (e.g., zinc-mercury alloy), an amalgam substance (e.g., indium-bismuth alloy) may be added into the glass tube 7 prior to the process of FIG. 1E so as to satisfy an intended use. In addition, after the formation of the pinch-sealed portion 10, the cassette may be separated during the process of exhaustion and filling, if required.

Note here that, in FIGS. 1A and 1B, the holding block 1 and the auxiliary holding block 2 or the cassette 12 may be fixed with a certain means, which is not illustrated, or may be in a state capable of being transferred and carried freely to a required location to be applicable to the mass production. In FIGS. 1E through 1G, the glass tube 7 also is held with an appropriate device.

According to this embodiment of the present invention, a fluorescent lamp can be manufactured smoothly by a continuous manufacturing process from the assembly process of an electrode to the exhaustion and filling process while a pair of parallel lead wires is held firmly and securely in the cassette. Therefore, inefficiency of the manufacturing process, loss of the material, variations in the product quality and the like can be reduced, so that the effects such as the reduction in the cost, the improvement of the mass-production capability and the improvement of the product quality can be obtained.

The method for manufacturing a fluorescent lamp of the present invention is not limited to materials, dimensions, power rating and shapes in the above-described embodiment and the following examples, and an optimum configuration can be selected freely. The following specifically describes the present invention, with reference to an example.

EXAMPLE 1

Figure 4:
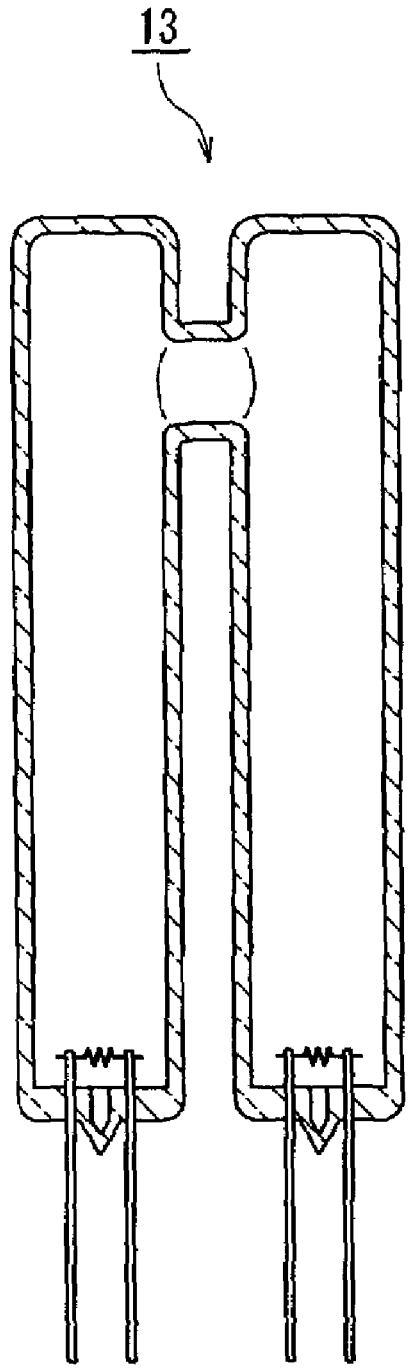
FIG. 4 is a cross-sectional view of a fluorescent tube according to one embodiment of the present invention.

Two glass tubes with an outer diameter of 15.5 mm, a wall thickness of 0.8 mm and an overall length of 180 mm were connected like a bridge to form one discharge path of a 13-watt type compact fluorescent lamp. This fluorescent lamp was manufactured following the processes of FIGS. 1A to G and the related description. FIG. 4 is a cross-sectional view of the thus obtained fluorescent tube.

8 mg of zinc-mercury alloy and 10 mg of indium-bismuth alloy were enclosed in the glass tube 7 as an alloy of emitting mercury and as an amalgam substance, respectively, before the process of FIG. 1E.

Comparative Example 1

For comparison, an electrode was assembled following the prior art example (JP 6(1994)-290735 A) in which lead wires are fixed with a glass bead, and a fluorescent lamp was manufactured in the same manner as with the ordinary fluorescent lamp manufacturing means, where the fixing with the glass bead was applied to the holding of the lead wires using a jig described in the prior art example (JP 49(1974)-3564 A). As a result, the manufacturing method as one embodiment of the present invention had the following advantages compared with the prior art methods:

(1) to eliminate a process of attaching the glass bead;

(2) to eliminate a transfer process from the glass bead attachment process to the electrode attachment process;

(3) to eliminate a holding process for transferring of the assembled lead wires with electrode to a pinch-sealing process; and (4) to improve the production capacity by 40% for the overall processes including the pinch-seal and the exhaustion.

In addition, in the manufacturing method according to the prior art, the supporting of the lead wires is unstable and the supporting power is weak, and therefore difficulties occur. For example, the glass bead cannot be fixed while keeping a precise gap between the pair of lead wires or the lead wires are detached from the supporting jig, which requires a reworking process. Also, a cause of the variations in the quality occurs because the electrode cannot be grasped with the lead wires precisely.

On the other hand, according to the embodiment of the present invention, there were no variations in the quality.

Furthermore, the fluorescent lamp manufactured according to the prior art method had a property of 830 to 850 lm, whereas the fluorescent lamp manufactured according to the method of the present invention had a property of 840 to 860 ml, though the thus obtained compact fluorescent lamp was a three-band fluorescent lamp with the color temperature of 5,000 K and the rating of 840 lm in average.

From these results, it can be confirmed that a certain degree of increase in the effective luminescent length, which results from the glass bead being eliminated from the end portion of the glass tube, contributes to the enhancement of the luminous flux.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method for manufacturing a fluorescent lamp comprising the steps of:

arranging a pair of lead wires between a holding block provided with two lead-wire grooves for grasping the pair of lead wires and an auxiliary holding block provided with grooves corresponding to the two-lead wire grooves in such a manner that both end portions of each of the pair of lead wires protrude out of the lead-wire grooves, whereby the pair of lead wires is supported to be sandwiched and to be fixed therebetween;

attaching an electrode to tip ends of the protruding lead wires;

inserting the lead wires that hold the electrode by grasping the same and protrude out of the holding block into an end portion of a glass tube for a fluorescent lamp, an inner surface of the glass tube being coated with a phosphor;

applying heat in the vicinity of the end portion of the glass tube so as to pinch-seal the lead wires to the glass tube; and detaching the holding block and the auxiliary holding block, wherein the holding block and the auxiliary holding block grasp an exhaust tube, and the exhaust tube is integrated with the glass tube during the step of anplying heat.

2. The method for manufacturing a fluorescent lamp according to claim 1, wherein at least one of the holding block and the auxiliary holding block is made of a magnetic substance.

3. The method for manufacturing a fluorescent lamp according to claim 1, wherein the holding block further comprises an exhaust-tube groove formed between the two lead-wire grooves for grasping an exhaust tube and the auxiliary holding block further comprises a groove corresponding to the exhaust-tube groove.

4. The method for manufacturing a fluorescent lamp according to claim 3, wherein the lead-wire grooves and the exhaust-tube grooves are provided at opposed surfaces of the holding block and the auxiliary holding block.

5. The method for manufacturing a fluorescent lamp according to claim 3, wherein after attaching the electrode to the tip ends of the protruding lead wires and before inserting the lead wires protruding from the holding block into the end portion of the glass tube, the exhaust tube is arranged so that both end portions of the exhaust tube protrude out of the exhaust-tube groove.

6. The method for manufacturing a fluorescent lamp according to claim 3, wherein when inserting the lead wires into the end portion of the glass tube, the exhaust tube also is inserted into the end portion of the glass tube.

7. The method for manufacturing a fluorescent lamp according to claim 3, wherein after pinch-scaling the lead wires by heat and before detaching the holding block and the auxiliary holding block, gas filled in the glass tube is exhausted through the exhaust tube.

8. The method for manufacturing a fluorescent lamp according to claim 3, wherein after detaching the holding block and the auxiliary holding block, a tip end portion of the glass tube is sealed by heat and the exhaust tube is cut and removed.

9. The method for manufacturing a fluorescent lamp according to claim 1, wherein only the electrode is present between the lead wires of the finished fluorescent lamp.

10. The method for manufacturing a fluorescent lamp according to claim 1, wherein when arranging the pair of lead wires so that the both end portions of each of the pair of lead wires protrude out of the lead-wire grooves, the pair of lead wires is held to be substantially parallel with each other.

* * * * *